US010626679B2

(12) United States Patent
Cooper et al.

(10) Patent No.: US 10,626,679 B2
(45) Date of Patent: Apr. 21, 2020

(54) BIDIRECTIONAL CLUSTER HAMMER REAMER

(71) Applicant: HARD ROCK HORIZONTAL DIRECTIONAL DRILLING PRODUCTS, INC., Winder, GA (US)

(72) Inventors: Cary Cooper, Winder, GA (US); Travis Parr, Winder, GA (US)

( * ) Notice: Subject to any disclaimer, the term of this patent is extended or adjusted under 35 U.S.C. 154(b) by 28 days.

(21) Appl. No.: 15/939,982

(22) Filed: Mar. 29, 2018

(65) Prior Publication Data

US 2019/0301246 A1 Oct. 3, 2019

(51) Int. Cl.

| | |
|---|---|
| ***E21B 10/36*** | (2006.01) |
| ***E21B 10/28*** | (2006.01) |
| ***E21B 1/00*** | (2006.01) |
| ***E21B 7/28*** | (2006.01) |
| ***E21B 7/04*** | (2006.01) |
| ***E21B 10/38*** | (2006.01) |

(52) U.S. Cl.
CPC ..... *E21B 10/28* (2013.01); *E21B 1/00* (2013.01); *E21B 7/046* (2013.01); *E21B 7/28* (2013.01); *E21B 10/38* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,735,584 | B2 * | 6/2010 | Purcell | E21B 7/28 175/389 |
| 9,376,869 | B1 * | 6/2016 | Lubrecht | E21B 7/20 |
| 2001/0006120 | A1 * | 7/2001 | Miyamoto | E21B 4/14 175/61 |
| 2009/0014392 | A1 * | 1/2009 | McEwen | B01D 17/0211 210/744 |

* cited by examiner

*Primary Examiner* — Giovanna C Wright
*Assistant Examiner* — Ronald R Runyan
(74) *Attorney, Agent, or Firm* — Smith Tempel Blaha LLC; Matthew T. Hoots

(57) ABSTRACT

A bidirectional cluster hammer reamer ("BCHR") for use in a horizontal direction drilling system comprises a plurality of percussive hammers and bits arranged around a central drive rod. The central drive rod is translatable between a forward most position and a rear most position. The central drive rod is translated to the forward most position when the BCHR is being pulled through a previously drilled pilot channel. The central drive rod is translated to the rear most position when a reverse feed force is applied to the BCHR. When in the rear most position, the central drive rod cooperates with an air distribution assembly at the rear of the BCHR to expel a portion of a pressurized fluid to the exterior of the BCHR for clearing accreted debris.

9 Claims, 10 Drawing Sheets

BIDIRECTIONAL CLUSTER HAMMER REAMER

BACKGROUND

The present disclosure relates to a percussion boring system and, more particularly, to an improved leading end assembly for a percussion boring system in the form of a bidirectional cluster hammer reamer ("BCHR").

A person having ordinary skill in the art understands that horizontal directional drilling systems are capable of directionally boring a winding channel in a substrate. These channels are commonly bored for any number of purposes such as for holding a product in the form of a conductive conduit, a fiber optic cable, a stretch of tubing, a sewer pipe, etc.

Percussion boring a subterranean channel for holding a product usually begins by boring a pilot channel in a substrate along a substantially predetermined path. The pilot channel has an entry point, where the leading end of the horizontal directional drilling system initially enters the substrate, and an exit point where the leading end of the system eventually emerges from the substrate. After the pilot channel is bored, a series of passes back and forth through the channel may be made to expand the channel size and condition its walls in anticipation of installing the product on the final pass.

Devices and methods for expanding a pilot channel vary greatly, and largely depend on the specific subterranean conditions being encountered. Generally, a pilot bore is expanded by either 1) retracting a reaming device and/or 2) pushing a relatively larger percussion bit.

Reaming devices known in the art are relatively simple in design and application—at the exit point of the pilot channel, the percussive bit used to drill the pilot channel is replaced with a slightly larger reaming device that is simply dragged back through the pilot channel when the drill string is retracted. In most applications, reamers work well to expand and condition a pilot channel. The advantage of reamers known in the art is that they can be pulled through a pilot channel by a retracted drill string, thereby alleviating any requirement for steering by the operator. The disadvantage of reamers known in the art, however, is that they are limited in the amount of channel expansion they can provide per pass.

An advantage of using percussive devices to expand a pilot channel is that percussive devices may provide for a relative increase in the amount of bore expansion that may be realized over a single pass when compared to a reamer. Just like the percussive bit used to bore the pilot channel, percussive devices used to expand the pilot channel are really just relatively bigger percussive bits capable of powering through rock and dirt. The disadvantage of using a percussive device for pilot channel expansion, however, is that the operator must take care to stay on the path of the pilot channel and not inadvertently bore off course. As one of ordinary skill in the art would understand, reaming devices stay on course by virtue of being pulled back through the channel, but percussive devices known in the art must be steered as they are "pushed" through the channel.

Therefore, systems and methods known in the art for expanding a subterranean pilot channel suffer from either a limited ability to expand a pilot channel as they are retracted or from the requirement that they be steered along the pilot channel as they are pushed. As such, there is a need in the art for a percussive boring system that may be pulled or retracted through a pilot channel so that the expansion of the pilot channel is optimized without the requirement that the system be steered.

SUMMARY

The present disclosure describes various embodiments, as well as features and aspects thereof, of a bidirectional cluster hammer reamer for use in a horizontal direction drilling system. More specifically, one exemplary embodiment of a bidirectional cluster hammer reamer comprises a hammer housing defining a front end and a rear end of the bidirectional cluster hammer reamer with a central drive rod positioned coaxially within the hammer housing. The central drive rod comprises a forward string connector and a rear string connector for mechanically engaging a forward drill string and a rear drill string of the horizontal direction drilling system. A plurality of percussion hammers is arranged within the hammer housing and around the central drive rod. The hammer housing further comprises one or more support plates configured to slidably engage the central drive rod and mechanically support the plurality of percussion hammers. A plurality of bits are positioned at the front end of the hammer housing, each bit slidably connected via a chuck component to an associated one of the plurality of percussion hammers. At the rear end of the hammer housing is an air distribution assembly comprised of a plurality of plates defining a series of flow paths. Pressurized fluid supplied through the central drive rod (from the drill string) is directed through the air distribution assembly flow paths to provide a motive force for promoting a percussive cycle in each of the plurality of percussion hammers.

It is envisioned that embodiments of a bidirectional cluster hammer reamer may comprise four to six percussion hammers, although the scope of a bidirectional cluster hammer reamer is not limited to having just four to six percussion hammers. The central drive rod may include one or more cutout areas on its surface and be configured to translate between a forward most position and a rear most position within the bidirectional cluster hammer reamer. When the central drive rod is in the forward most position the cutout areas cooperate with the air distribution assembly to supply the pressurized fluid to the plurality of percussion hammers. And, when the central drive rod is in the rear most position the cutout areas cooperate with the air distribution assembly to supply the pressurized fluid to the exterior of the bidirectional cluster hammer reamer. Moreover, in some embodiments, when the central drive rod is in the rear most position the cutout areas cooperate with the air distribution assembly to supply a first portion of the pressurized fluid to the plurality of percussion hammers and a second portion of the pressurized fluid to the exterior of the bidirectional cluster hammer reamer.

Various embodiments, configurations, features and aspects of the improved leading end assembly for a percussion boring system are described in more detail in the detailed description with reference to the attached drawings.

DETAILED DESCRIPTION

Figure 1:
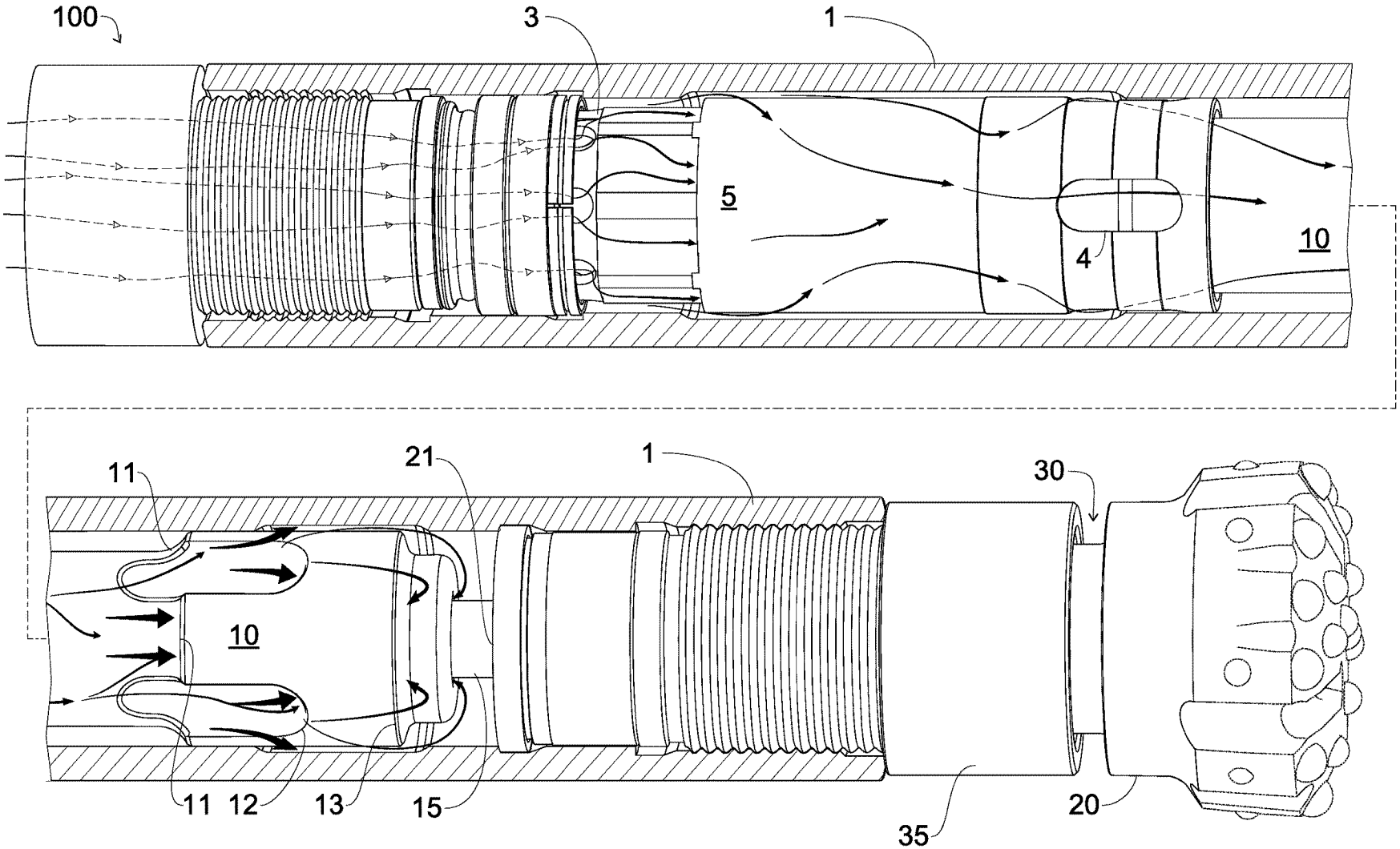
FIG. 1 PRIOR ART
FIGS. 1-3 illustrate the basic percussive cycle of a hammer in a horizontal directional drilling ("HDD") boring arrangement.

The following written description explains various embodiments of a bidirectional cluster hammer reamer for use in a horizontal direction drilling system. This written description refers to the appended drawings to supplement the written explanation. As such, the written words should not be construed as limitations. Numerous specific details are explained in the written description and/or depicted in the drawings to provide an enabling understanding of the various embodiments to a person having ordinary skill in the art. Some details, however, need not be expressly explained because they would be readily apparent and understood by a person having ordinary skill in the art. For example, certain described embodiments and explanations of some specific details are omitted so as to not unnecessarily obscure or complicate the written description. Additionally, a person having ordinary skill in the art would understand that the various embodiments might be practiced without some or all of these specific details.

Although throughout the detailed description the various embodiments are directed towards a bidirectional cluster hammer reamer for a percussion boring system configured for horizontal directional drilling, it should be understood that the focus of such description is only to ensure clarity in the configuration and operation of the various embodiments. The description should not be used to limit the usefulness of the various embodiments in other manners or for other uses.

With the above in mind, the words "exemplary" and "non-limiting" are used herein to mean serving as an example, instance, or illustration. Any aspect described herein as "exemplary" or "non-limiting" is not necessarily to be construed as exclusive, preferred or advantageous over other aspects.

Certain embodiments and aspects of the present description provide a bidirectional cluster hammer reamer for a horizontal directional drilling system, the bidirectional cluster hammer reamer configured to expand a pilot hole previously drilled along a predefined subterranean path by a horizontal directional drilling system. Generally, horizontal directional drilling ("HDD") is the practice of drilling non-vertical, non-linear bores. A common application for HDD is for the installation of utility products such as underground wiring, small bore piping, cable bundles, and the like. While HDD applications generally require relatively accurate boring, certain HDD applications, however, require a particularly high degree of accuracy such as, for example, a "sewer grade" bore which will be used to accommodate sewer piping. A sewer grade bore must typically have less than 0.5% deviation from the predetermined path over a 300 foot run.

The HDD process typically begins with drilling a pilot bore along a desired underground path. Next, the pilot bore is enlarged to a desired diameter and its walls conditioned by pulling a larger cutting tool, sometimes termed a "reamer" or "back reamer," back through the pilot hole. Finally, the product is installed in the enlarged hole by way of being pulled behind the reamer as the drill string is retracted from the reamed bore. Notably, embodiments of the present solution are employed during the steps of enlarging the pilot bore and, as such, may be used in lieu of, or in preference to, a typical back reamer that is understood in the art.

As one of ordinary skill in the art of HDD percussion boring would recognize, when drilling a pilot bore the drill string is pushing forward, thereby facilitating a percussion cycle with a hammer component and a slidably engaged drill bit on the leading end of the drill string. The hammer in an HDD drill string of this sort is not able to "run on cushion," meaning that the reciprocation of the hammer will cease upon retraction of the drill string due to a resulting "open blow" alignment of internal air passages. That is, when an HDD leading end assembly includes a hammer and a slidably engaged drill bit, the hammer cannot percuss and strike the drill bit when the drill string is being retracted in a direction opposite to the forward orientation of the hammer. Consequently, when drilling a pilot bore, a drill string is typically advanced (as opposed to retracted) such that it "pushes" the hammer and drill bit forward into the subterranean substrate. As will be better understood from the drawings and related descriptions, embodiments of the present solution leverage a plurality of hammer/drill bit assemblies in a single device that may be either "pushed" or "pulled" through a previously drilled pilot bore such that the percussive cycles of the hammers are promoted.

Returning to the high level explanation of HDD systems and methods, as is understood by a person having ordinary skill in the art, the drill bit of an HDD drill string engages with the substrate to be bored and works to erode the substrate at the point of engagement during the percussion boring process. The at least one exhaust port of the bit may be configured to expel a fluid, either drilling fluid, compressed air or any other fluid known to a person having ordinary skill in the art, such that any eroded substrate at the point of engagement is cleared away from the drill bit assembly. This prevents the drill bit assembly from becoming clogged, which can restrict any necessary freedom of movement between the component parts. This also facilitates the circulation of the drilling fluid in the channel (I.e., the pilot bore), which cools the moving parts of the drill string. This also facilitates the removal of previously eroded substrate from the channel as the percussion boring process continues.

Drilling fluid may be compressed air, a viscous liquid mixture of water and bentonite, or any other similar combination known to a person having ordinary skill in the art. During a boring process, the drilling fluid is typically continuously pumped to the drill bit and expelled from ports in the drill bit. The drilling fluid may be useful for holding eroded substrate particles in suspension and lubricating the bored channel for the drill string and/or the pulled product. Advantageously, these properties of the drilling fluid help stabilize the channel walls, cool the drill bit, alleviate the pressure on the drill bit and prevent a building-up of substrate particles at the drill bit during the boring process.

The drilling fluid may be recycled throughout the boring process by a reclaimer that circulates the drilling fluid expelled from the drill bit back through the channel and back through the drill string. During this recycling process, the reclaimer may additionally remove the substrate particles from the drilling fluid and regulate/maintain the drilling fluid's ideal viscosity.

Figure 2:
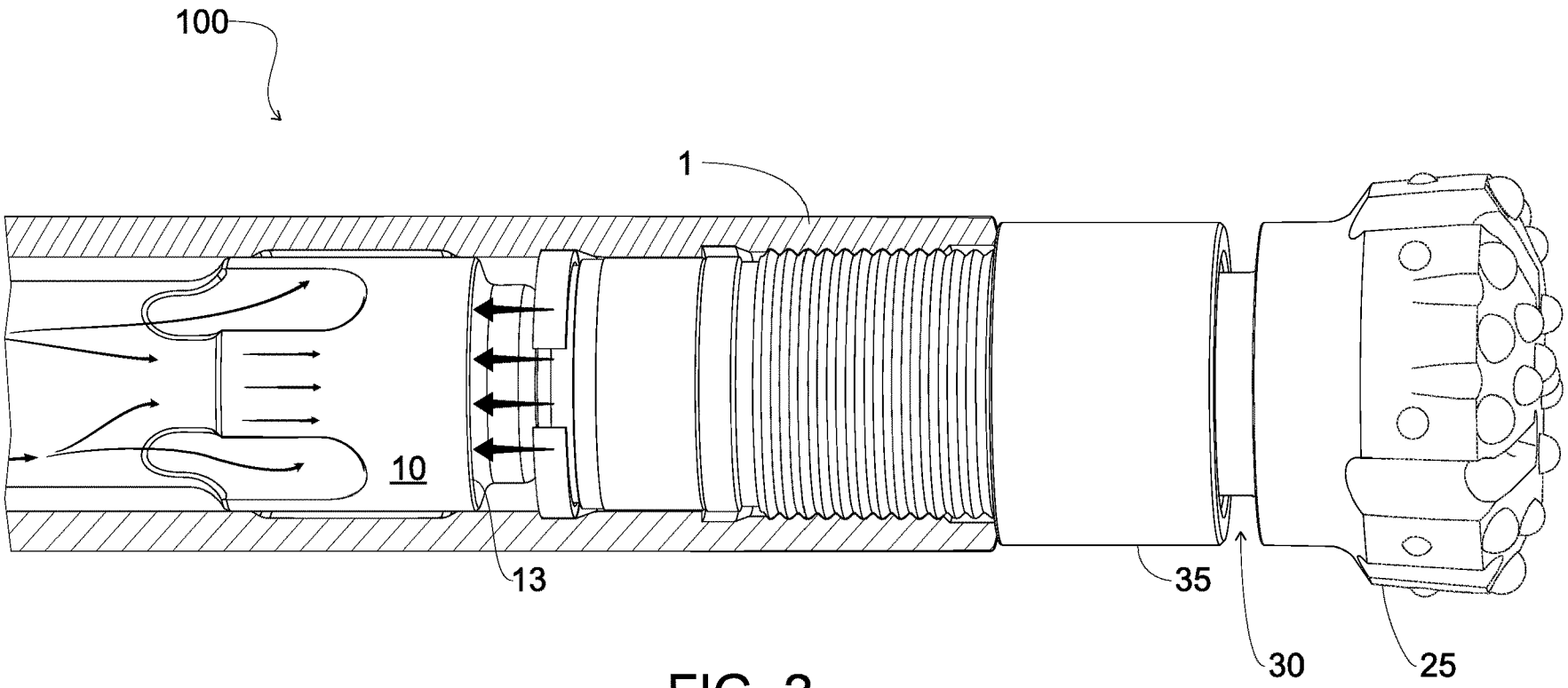
FIG. 2 PRIOR ART
Figure 3:
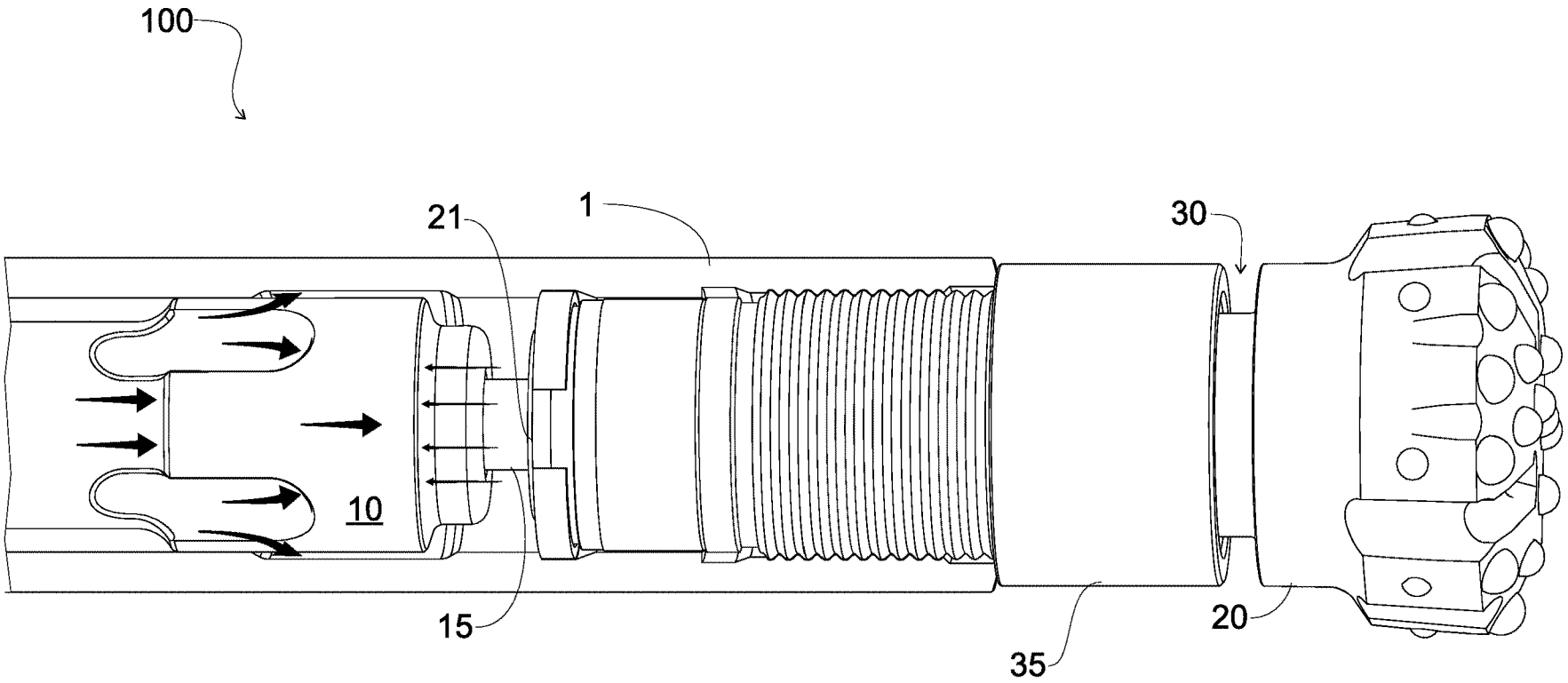
FIG. 3 PRIOR ART

Referring to the illustrations in FIGS. 1-3, an understanding of the basic percussive cycle of a hammer in a horizontal directional drilling ("HDD") boring arrangement is useful. FIGS. 1-3 illustrate the percussive cycle delivered by a piston 10 to the impact surface 21 of a drill bit 20 in an HDD drill string configured for boring. In the FIGS. 1-3, the drill string may be envisioned as providing a feed force from left to right. As one of ordinary skill in the art would understand, as the feed force is applied to the exemplary HDD boring arrangement illustrated in FIGS. 1-3 (I.e., as the drill string is pushed forward), the percussive cycle of the hammer piston 10 is promoted, thereby repeatedly delivering blows to the impact surface 21 of a slidably engaged drill bit 20. Moreover, as one of ordinary skill in the art would understand, in addition to applying a feed force, the drill string may provide mechanical rotation, hydraulic fluid, electric signals, etc.

Beginning at FIG. 1, a portion of a leading end assembly of an HDD drill string is shown and includes, generally, a hammer 1 containing an air distributer 3, an inner cylinder 5 and a piston 10. Also shown in the FIG. 1 illustration is a drill bit 20. The drill bit 20 has a splined shaft and is slidably engaged with the hammer 1 via a chuck 35. The arrows indicate air flow from an air supply (or other fluid supply) delivered to the air distributor 3 from the drill string, as would be understood by one of ordinary skill in the art. As can be learned from the arrows, the air is distributed radially through a series of holes positioned circumferentially around the air distributor 3. As the air radially exits the holes of the air distributor 3, the air passes along the outer surface of the inner cylinder 5 in the hammer component 1 and toward the leading end of the drill string where the slidably engaged drill bit 20 is located.

The air continues along the outer surface of the inner cylinder 5 and passes down through a series of ports 4 on the lower end of the inner cylinder 5. After passing down through the series of ports 4 on the lower end of the inner cylinder 5, the air continues along the outer surface of a piston 10 that is slidably engaged within the inner annular area of the inner cylinder 5. The air acts on and applies a force to an upper ledge(s) 11 and various "cut out" areas 12 in the piston 10, thereby causing the piston 10 to begin advancing forward (to the right in the illustration) relative to the inner cylinder 5.

The air continues to exert a greater and greater force on the upper ledge(s) 11 and the various "cut out" areas 12 in the piston 10 as it builds in pressure (the "thicker" arrows in the illustration represent forces that are relatively greater than the "thinner" arrows). As can be seen in the FIG. 1 illustration, air pressure is beginning to build up on a lower ledge 13 of the piston 10 and exerting a force back toward the inner cylinder 5. However, because the forces toward the drill bit 20 are greater, the piston 10 is advancing toward the impact surface 21 of the drill bit 20. The blow tube 15 can be seen in the FIG. 1 illustration, as it begins to engage into a central air passageway through the center of the piston 10. The air supply through the blow tube 15 ultimately exits out through the drill bit 20 and assists in the boring process. Notably, if the drill bit 20 is advanced far enough ahead of the piston 10 stroke range (such as when the drill string is being retracted relative to the boring direction), the blow tube 15 may be exposed and any air supply that would have otherwise contributed to the percussive cycle is provided with an escape route ("open blow" arrangement), as would be understood by one of ordinary skill in the art.

Turning to FIG. 2, the piston 10 has advanced forward enough that a percussive blow has been delivered to the impact surface 21 of the drill bit 20. And so, the continued supply of air pressure from the distributor 3 has begun to accumulate on the lower ledge 13 of the piston 10 and is exerting a relatively large force back toward the inner cylinder 5. The position of the drill bit 20 (the head 25 of the drill bit 20 is the "business end" of the drill bit that is hammered into the subterranean earth to create a pilot bore) can be seen relative to the chuck 35 when the piston 10 is in contact with impact surface 21 of the drill bit 20.

Notably, the gap 30 represents the "sweet spot" of the bit relative to the piston stroke range. If the drill bit 20 were advanced further to the right, the impact surface 21 of the bit 20 would be too far away from the piston 10 to receive a useful percussive blow or the percussive cycle would be interrupted. Moreover, if the bit 20 were advanced to the left such that the gap 30 is significantly reduced, the impact surface 21 of the bit 20 would be too close to the piston 10 such that the percussive blows would be detrimental to the drill string or the percussive cycle would be interrupted. As a result, in a boring configuration the drill bit 20 finds that position represented by gap 30 where the percussive cycle is urged and the piston 10 can deliver continuous blows. As the drill bit head 25 works to drill the pilot bore, pressure out ahead of the drill bit head 25 resulting from the portion of the air supply delivered through the blow tube 15 diminishes, thereby allowing the drill bit 20 to extend out of reach of the piston 10 stroke range; the advancement of the drill string, however, works to push the chuck 35 (and everything behind it in the drill string) forward relative to the slidably engaged drill bit 20, thereby providing for the continuous maintenance of gap 30.

Turning now to FIG. 3, the piston 10 has retracted to the other end of its stroke range and air pressure is starting to build up as described above relative to the FIG. 1 illustration. The piston 10 will start to advance toward the drill bit 20 to deliver its next percussive blow to the impact surface 21, after which the advancement of the drill string will work to maintain gap 30. The percussive cycle continues. Notably, it can be seen in FIG. 3 that even though the piston 10 has retracted to its left-most position in its stroke range, the gap 30 is maintained for the reasons described above. Advantageously, as long as gap 30 is maintained, I.e., as long as the impact surface 21 of the drill bit 20 is positioned in the "sweet spot" relative to the stroke range of the piston 10 in the hammer 1, the percussive cycle will repeat and percussive blows to the impact surface will be continually delivered.

Figure 4:
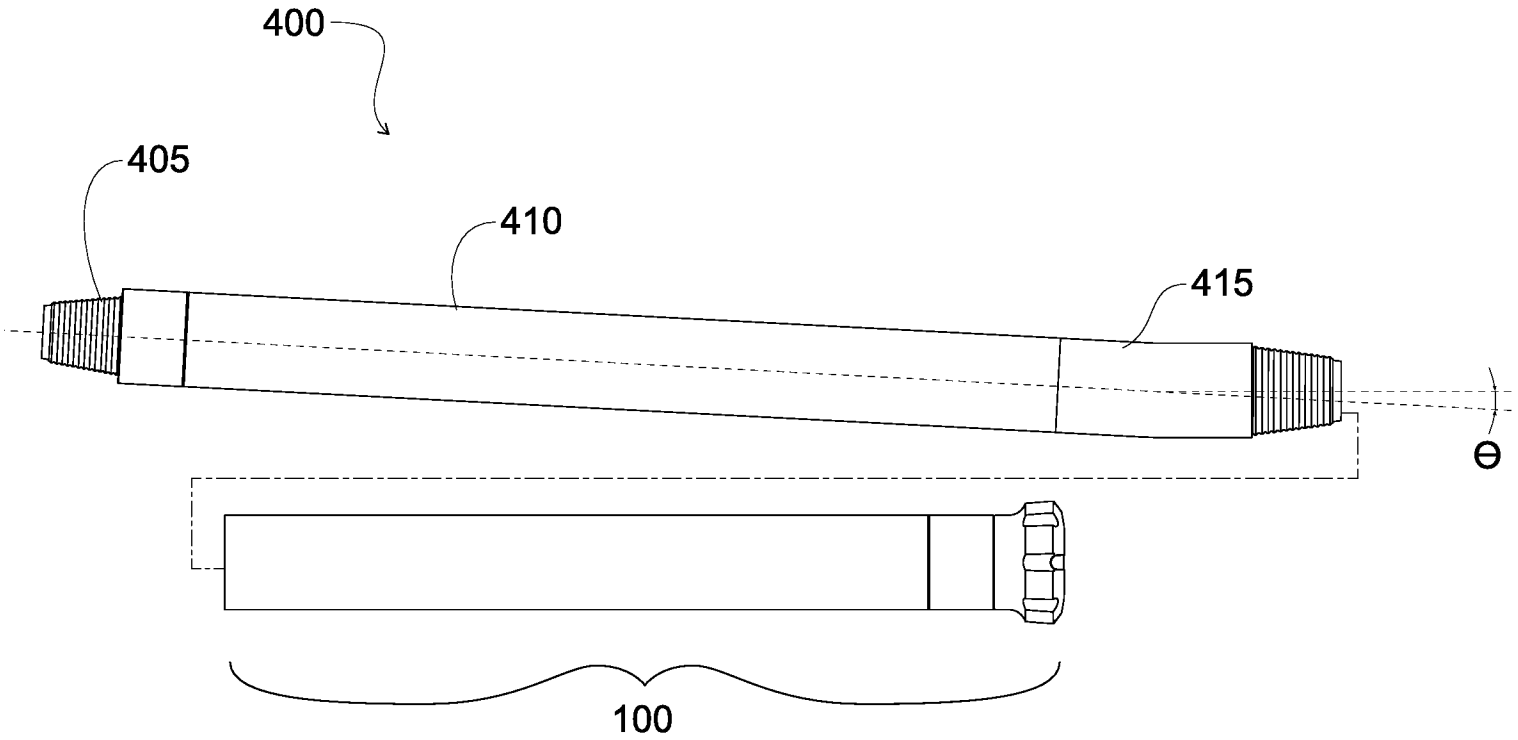
FIG. 4 PRIOR ART
FIG. 4 illustrates certain common exemplary embodiments of HDD systems having a bent sub.

As further context to the FIGS. 1-3 illustration of a basic percussive cycle of a hammer in a horizontal directional drilling ("HDD") boring arrangement, FIG. 4 illustrates certain common exemplary embodiments of percussion boring systems known to a person having ordinary skill in the art. As can be seen in the FIG. 4 illustration, a typical HDD percussion boring system comprises a drill string (not shown) and a common leading end assembly 400. The common leading end assembly 400 is typical of a leading end assembly that may be employed by those of ordinary skill in the art to drill a pilot bore or pilot channel. As will be better understood from subsequent figures, embodiments of the solution may comprise an arrangement of what amounts to multiple of the components 100 (hammer/bit combinations) seen in the common leading end assembly 400.

Returning to the FIG. 4 illustration, the common leading end assembly 400 typically comprises the components 100 described in the FIGS. 1-3 illustration in addition to certain other components including a sonde housing 410 and a bent sub 415. A common leading end assembly 400 may be configured to detachably and functionally couple, directly or indirectly, to the drill string via a threaded connection 405 on the backend of the sonde 410. Although not shown in the FIG. 4 illustration, as would be understood by one of ordinary skill in the art the sonde assembly 410 may house a sub-assembly of various instrumentation and transmitters for measuring and relaying various environmental conditions (e.g., the relative position of the leading end assembly in the substrate, the rotational orientation of the leading end assembly in the channel, and the thermal and pressure conditions in the channel).

As can be seen in the FIG. 4 illustration, the bent sub 415 may be coupled via a threaded connection on the leading end of the sonde 410. The bent sub 415 provides an angle or bend in the common leading end assembly 400 that allows an operator to "steer" the drill string along a subterranean path that may include one or more turns. As one of ordinary skill in the art would understand, when drilling a pilot bore along a straight section of a subterranean path, the entire drill string may be rotating while the drill bit percusses (as described above). But, when the pilot bore must take a turn in the subterranean path, rotation of the drill string may be stopped so that the bent sub 415 is positioned to urge a turn. With the bent sub 415 "clocked" to a certain position in the pilot bore, and rotation of the string stopped, advancement of the string while the bit 20 percusses will cause the pilot bore to make a turn, as would be understood by one of ordinary skill in the art.

Referring to the sonde 410, it may be configured to house instrumentation that transmits measurement data to a percussion boring system operator at the surface, as would be understood by a person having ordinary skill in the art. The transmitted measurement data may be encoded into an electro-magnetic signal and transmitted, regardless of its encoding form, through the substrate, directly or indirectly, to the percussion boring system operator. The measurement data may be useful for determining whether the drill string should be elongated, redirected, or retracted. The measurement data may also be useful for determining the extension length and, ultimately, the amount of pressure that should be applied to the drill string as it is forced into the substrate.

The measurement data may be further useful for: determining the rotations per minute of the drill string; adjusting the rotational orientation of the common leading end assembly in the channel; adjusting the hydraulic pressure of the drilling fluid in the drill string; and controlling the circulation of the drilling fluid in the channel. Ultimately, the measurement data gathered and transmitted by the common sonde assembly 410 may also be useful and functional for controlling the relative position of the common leading end assembly, in the substrate, and the direction towards which the common leading end assembly bores.

Consequently, as is understood by a person having ordinary skill in the art, locating the relative position of the common leading end assembly 400 in the substrate, via the common sonde 410, and adjusting the rotational orientation of the common leading end assembly in the channel, via rotation of the drill string, is an important part of a directional percussion boring process. In one non-limiting variation, a "walk-over" locating system is configured to obtain measurement data from the common sonde 410, and/or locate the common leading end assembly 400 through its own sensors. Once the transmitted measurement data is received it may be decoded and/or relayed to the percussion boring system operator.

As briefly explained above, an exemplary embodiment of a bent sub 415 may be bent at an angle relative to the drill string such that the remaining components 100 of the common leading end assembly 400, below the bent sub 410, is also at angle relative to the drill string (see angle theta "θ" in the FIG. 4 illustration). The result, as is understood by a person having ordinary skill in the art, is a percussion boring system with a common leading end assembly 400 that includes a portion 100 that is slightly bent to one direction relative to the associated drill string. The specific bend angle of the bent sub 415 may be application specific.

In one non-limiting variation, a bent sub 415 comprises a bend angle range of substantially between 1.0°-3.0° relative to the longitudinal axis of the drill string substantially proximate to the common leading end assembly 400. In another non-limiting variation, the bent sub 415 and the common sonde 410 are situated relative to one another such that locating the common sonde 410, as described above, allows for an inference of the direction, in the channel, towards which the components 100 of the common leading end assembly 400 is bent. Consequently, the percussion boring system to which the bent sub 415 and the common sonde 410 pertain is configured such that any adjustment of the rotational orientation of the common leading end assembly 400 in the channel (I.e., the pilot bore), via rotation of the drill string, results in a relatively precise adjustment of the direction towards which the drill bit 20 of the common leading end assembly 400 is aimed and, ultimately, the direction towards which the common leading end assembly 400 bores.

Beginning now with FIG. 5, certain embodiments and aspects of the solution provide a new reaming device that leverages a plurality of hammer/drill bit combinations (a "cluster hammer") to enlarge a previously drilled pilot bore. Advantageously, because embodiments of the solution may benefit from a feed force resulting from a pulling force, as opposed to a pushing force, a bent sub 415 is not required in order to direct the solution along the previously drilled subterranean path in order to ream and expand the pilot channel. Further, it is an advantage of embodiments of the solution that it is bidirectional in that a reverse force to the feed force will actuate an internal shaft that, in turn, redirects air to clear debris accumulated behind the reamer.

Figure 5A:
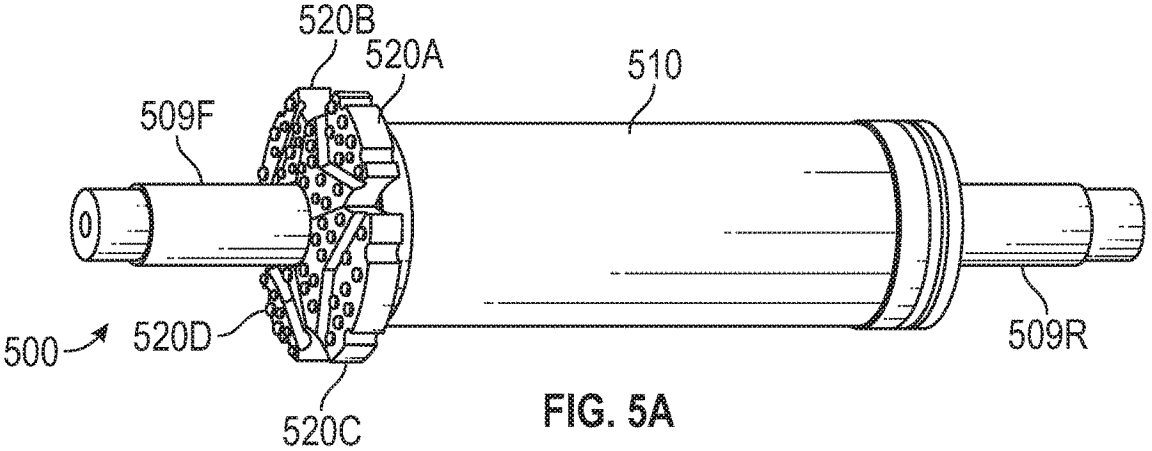
FIGS. 5A-5B illustrate assembled and exploded views, respectively, of an exemplary bidirectional cluster hammer reamer ("BCHR") according to an embodiment of the solution.
Figure 5B:
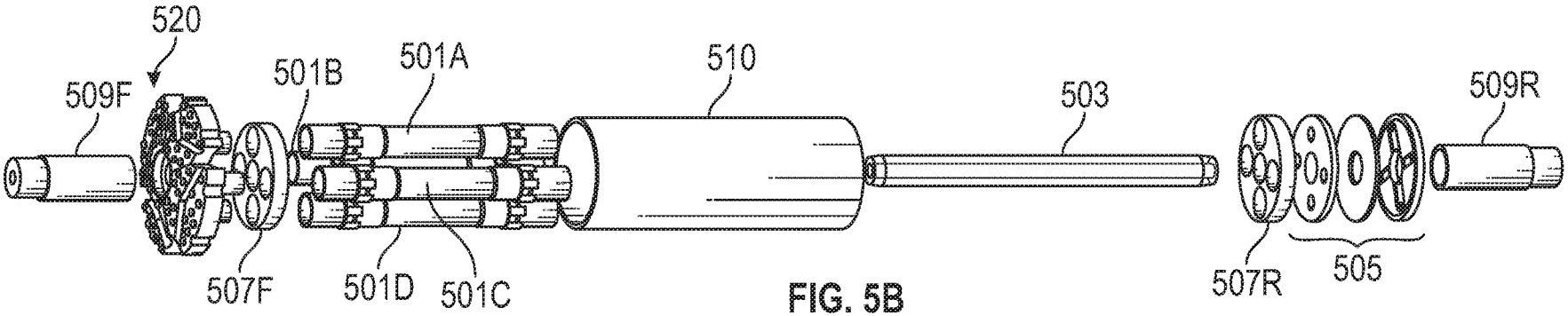

FIGS. 5A-5B illustrate assembled and exploded views, respectively, of an exemplary bidirectional cluster hammer reamer ("BCHR") 500 according to an embodiment of the solution. A hammer housing 510 contains a series of hammers 501, each hammer 501 configured to percuss a corresponding segmented bit 520. The hammers 501 operate according to a percussive cycle described above relative to FIGS. 1-3. The segmented bits 520 are each slidably engaged with a hammer 501 similar to the bit 20 and hammer 1 of FIGS. 1-3. Unlike the bit 20 of FIGS. 1-3 which is a single bit configured for drilling a pilot bore, however, the segmented bits 520 collectively form a circular bit arrangement around an axis defined by a drill string. In this way, as the drill string (not shown in FIG. 5) is pulled through a previously drilled pilot channel, the segmented bits 520 are positioned to engage with the substrate forming the pilot channel walls in order to erode the substrate at the point of engagement and expand the channel. The segmented bits 520 are each percussed by their respective hammer to facilitate the channel expansion.

Notably, although the exemplary embodiment 500 depicts segmented bits 520 arranged around a central axis defined by the drill string (see FIG. 6 for detailed view of a segmented bit 520), it is envisioned that other embodiments may leverage an array of hammer and bit combinations that employ round bits such as slant bit 20 of FIGS. 1-3. Further, although the exemplary embodiment 500 depicts an array of four hammer and bit combinations, such is just for convenience of depiction—it is envisioned that embodiments of the solution may comprise any number of hammer and bit combinations in a substantially circular array around a center axis defined by a drill string without departing from the scope of the invention.

Returning to the FIG. 5 illustrations, a central drive rod 503 is positioned coaxially within the hammer housing 510 and is mechanically connected to a forward and/or rear drill string via the forward string connector 509F and/or the rear string connector 509R, respectively. A pair of hammer support plates 507F, 507R are also within the hammer housing 510 and configured to position and mechanically secure the central drive rod 503 and the hammers 501. As can be understood from the illustrations, the central drive rod 503 is coaxially positioned within the hammer housing 510 while the various hammers 501 are circumferentially positioned within the hammer housing 510 around the central axis.

A series of air distribution plates 505 are positioned at the rear of the hammer housing 510 and are configured to work with the central drive rod 503 to distribute pressurized air delivered by the drill string to the various hammers 501 and/or to the exterior of the BCHR 500, as will become more apparent from subsequent drawings and description. Notably, although the exemplary embodiment of a BCHR 500 depicted in the figures includes an arrangement of three air distribution plates, it is envisioned that embodiments of the solution may be able to provide similar functionality with more or less air distribution plates and, as such, the scope of the solution is not limited to an embodiment comprising an arrangement of three air distribution plates.

Further, and as will become more apparent and better understood from subsequent drawings and their descriptions, the central drive rod 503 is slidably engaged within the hammer support plates 507 such that when a pushing feed force is applied to the rear string connector, or a pulling feed force is applied to the forward string connector, the central drive rod 503 translates forward such that air distribution cutouts within the central drive rod 503 cooperate with air distribution channels in the air distribution plates 505 to distribute pressurized air to the various hammers 501. Similarly, when a pulling feed force is applied to the rear string connector, or a pushing feed force is applied to the forward string connector, the central drive rod 503 translates backward such that the air distribution cutouts within the central drive rod 503 cooperate with the air distribution channels defined by the air distribution plates 505 to distribute pressurized air externally to the rear of the BCHR 500 in order to clear accreted debris. In some embodiments, when the central drive rod 503 translates backward such that the air distribution cutouts within the central drive rod 503 cooperate with the air distribution channels defined by the air distribution plates 505 to distribute pressurized air externally to the rear of the BCHR 500, the cutouts further cooperate with the air distribution channels defined by the air distribution plates 505 to distribute a portion of the pressurized air to the various hammers 501 in order to generate a degree of vibration that may assist in clearing of accreted debris around the BCHR 500.

Figure 6:
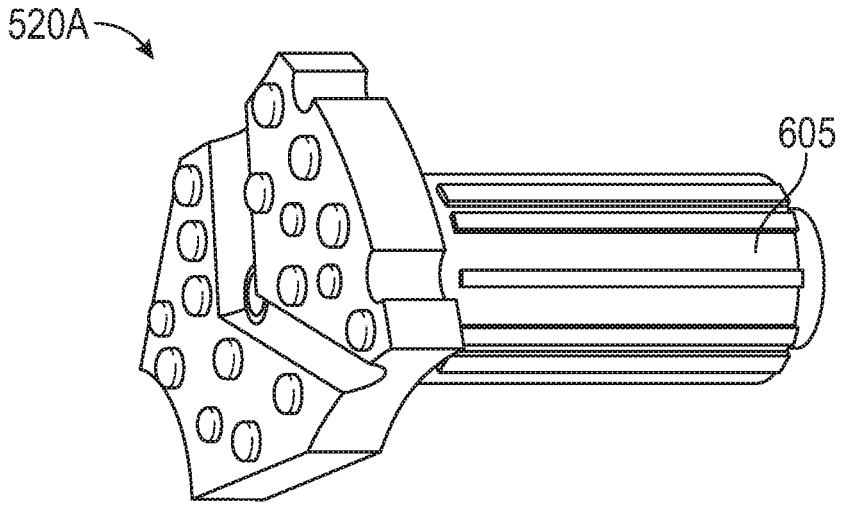
FIG. 6 illustrates an exemplary splined bit segment that may be driven by a hammer comprised within an exemplary bidirectional cluster hammer reamer ("BCHR") such as, but not limited to, the BCHR of FIG. 5.

Turning now to FIG. 6, illustrated is an exemplary splined bit segment 600 that may be driven by a hammer 501 comprised within an exemplary bidirectional cluster hammer reamer ("BCHR") such as, but not limited to, the BCHR 500 of FIG. 5. Like the bit 20 of the FIGS. 1-3 illustration, the splined bit segment 600 includes a shaft 605 with a plurality of longitudinal splines. The splines are configured to engage with complimentary splines located on the inside annular wall of a chuck, such as chuck 35 in the FIGS. 1-3. In doing so, the splined bit segment 600 may slidably engage with the chuck such that the segment 600 reciprocates in response to percussive strikes received from its associated hammer 501. Unlike the bit 20, however, the splined bit segment 600 comprises a wedge or "pie shaped" head configured to cooperate with juxtaposed splined bit segments to form a circular bit arrangement around the axis collectively defined by a central drive rod 503, forward string connector 509F and rear string connector 509R (as can be understood from FIG. 5). Notably, although the particular embodiment of a BCHR 500 shown and described includes a plurality of splined bit segments 600 that work cooperatively to form a circular bit arrangement, it is envisioned that other embodiments of a BCHR may leverage a plurality of round bits, such as bit 20, arrayed concentrically around the axis.

Figure 7:
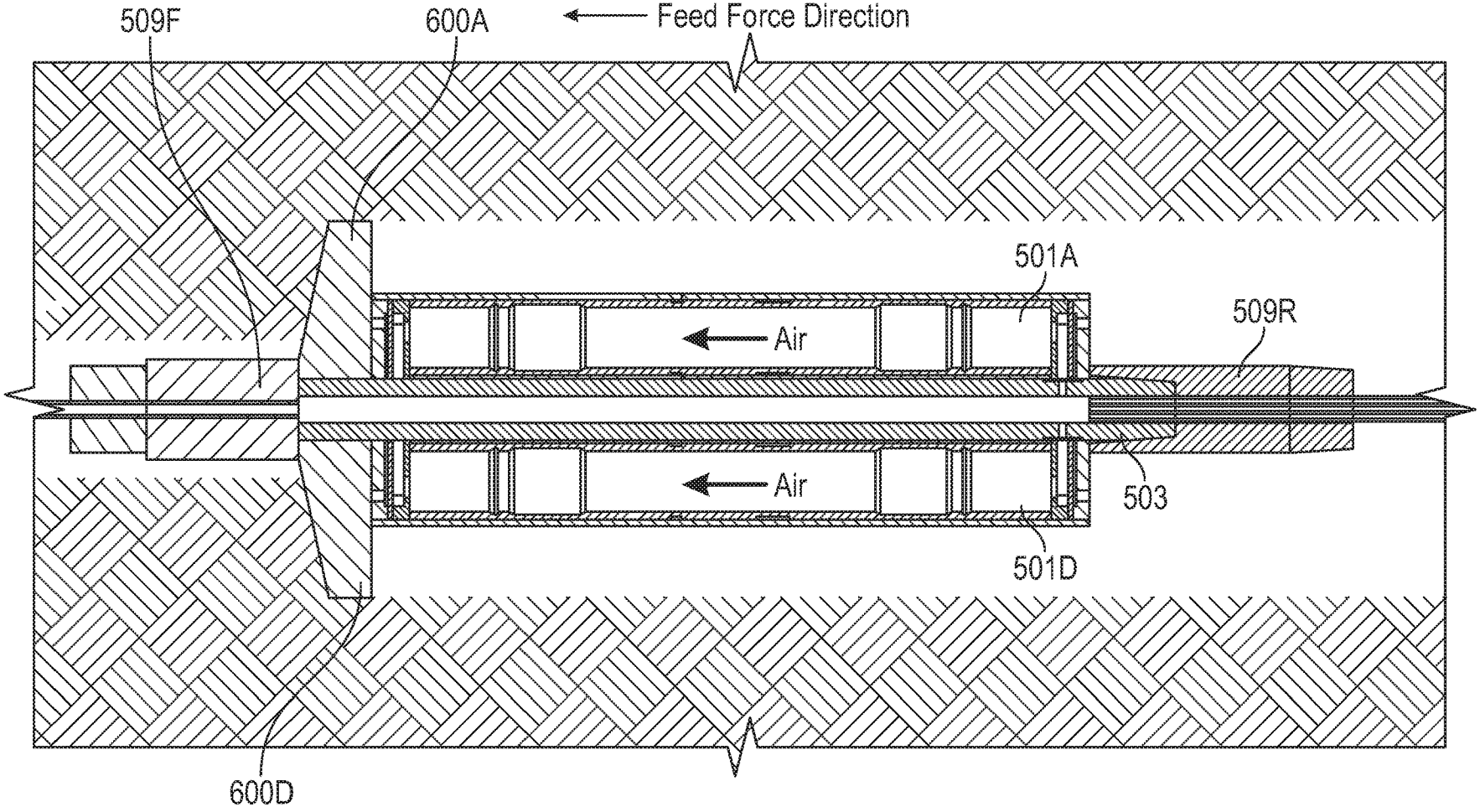
FIG. 7 illustrates a cross-sectional view of the exemplary bidirectional cluster hammer reamer ("BCHR") of FIG. 5, shown in a "pull" state.

FIG. 7 illustrates a cross-sectional view of the exemplary bidirectional cluster hammer reamer ("BCHR") of FIG. 5, shown in a "pull" state. With a feed force applied from right to left (either from the forward string "pulling" and/or the rear string "pushing"), the BCHR 500 in the FIG. 7 illustration is urged forward through the previously drilled pilot bore. Accordingly, and as previously described, the hammers (exemplary hammers 501A, 501D shown in the cross-sectional view) engage in a percussive cycle resulting from an internal motive force in the form of pressurized air combined with the feed force that is pulling/pushing the bit segments 600 into the substrate. The bit segments 600, "hammer" forward and backward to clear the substrate and expand the pilot bore, as previously described. The cuttings and debris generated by the forward advancement of the BCHR 500 through the pilot bore may build up around and behind the BCHR 500.

Figure 8:
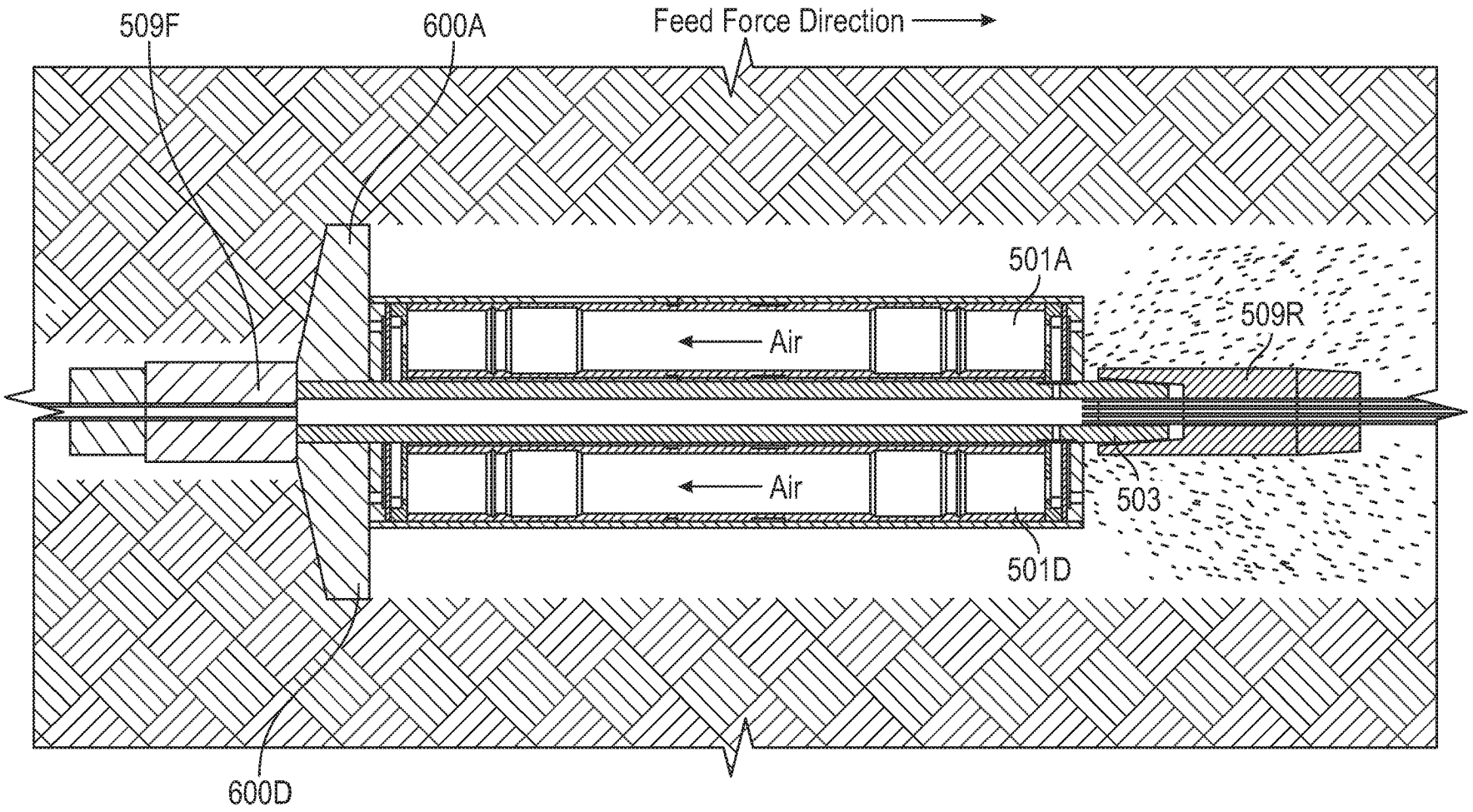
FIG. 8 illustrates a cross-sectional view of the exemplary bidirectional cluster hammer reamer ("BCHR") of FIG. 5, shown in a "push" state.

FIG. 8 illustrates a cross-sectional view of the exemplary bidirectional cluster hammer reamer ("BCHR") of FIG. 5, shown in a "push" state. With a feed force applied from left to right (either from the forward string "pushing" and/or the rear string "pulling"), the BCHR 500 in the FIG. 8 illustration is urged backward slightly from its advancement through the previously drilled pilot bore. Accordingly, the central drive rod 503 translates backward thereby causing the rear string connector 509R to disengage from its seat against the air distribution plates. In doing so, internal airways within the air distribution plates cooperate with cutouts on the central drive rod 503 to divert some of the pressurized air away from the hammers 501 and expel it to the rear of the BCHR 500. Advantageously, the expelled pressurized air may work to clear any accreted debris from around the BCHR 500. Also, because the air distribution plates 505 and the cutouts on the central drive rod 503 may not cooperate to divert the entire volume of pressurized air to the exterior of the BCHR 500, a portion of the pressurized air may still be supplied to the hammers 501 as a motive force to urge the percussion cycle such that the bit segments 600 continue to "chatter" or "vibrate" or "reciprocate" and help to dislodge and clear accreted debris.

Figure 9A:
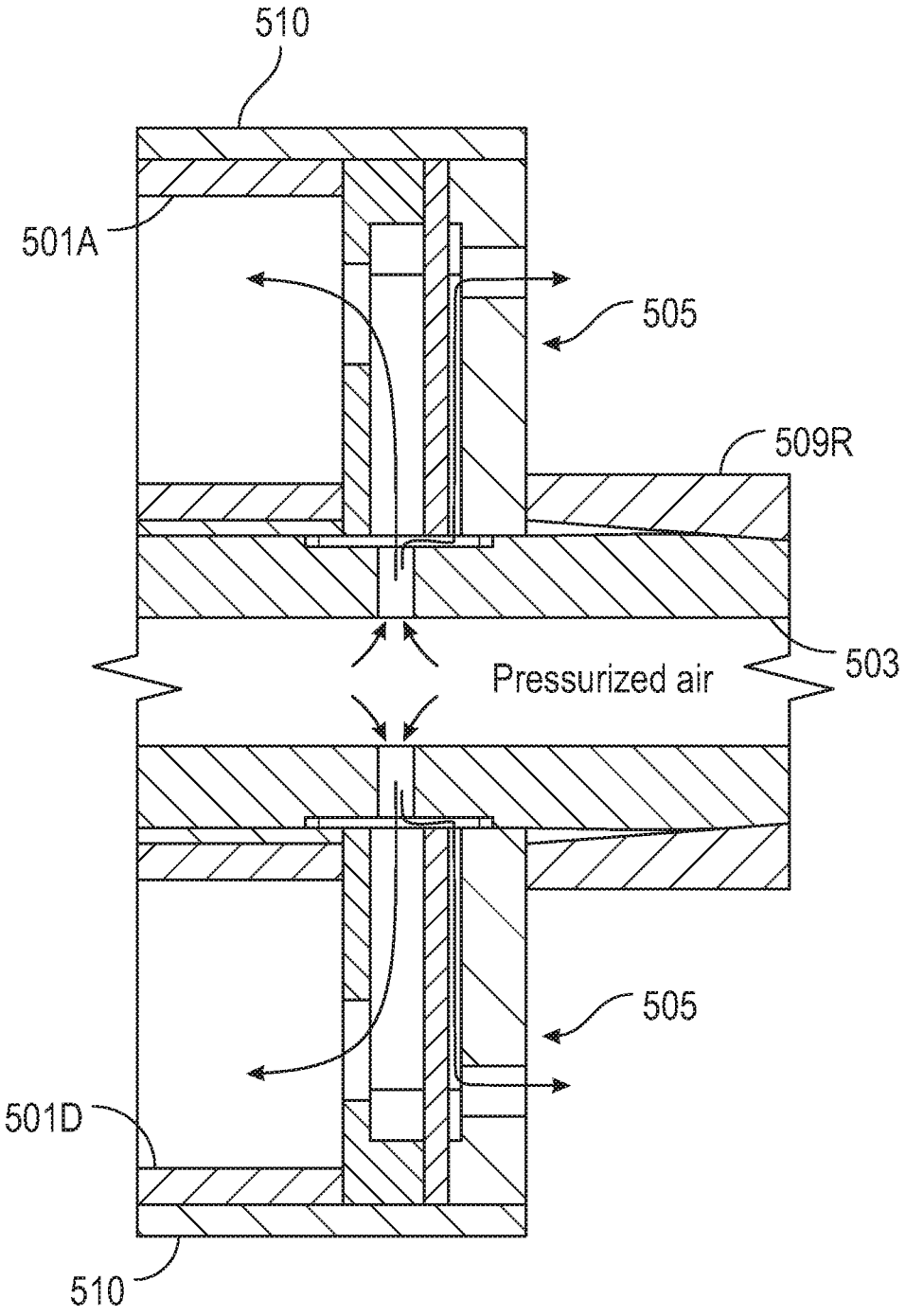
FIG. 9A illustrates a close-up view of the internal air flow path through the air distribution plate assembly of the exemplary bidirectional cluster hammer reamer ("BCHR") of FIG. 5 when it is in a "pull" state such as depicted in FIG. 7.

FIG. 9A illustrates a close-up view of the internal air flow paths through the air distribution plate assembly 505 of the exemplary bidirectional cluster hammer reamer ("BCHR") of FIG. 5 when it is in a "pull" state such as depicted in FIG. 7. Notably, although in this description when the BCHR 500 is in the forward advancing cutting mode it is referred to as the "pull" state, it will be understood that a feed force generated by a "push" of the rear drill string, as opposed to a feed force generated by a "pull" of the forward drill string, would also operate to seat the rear string connector 509R and direct the internal pressurized air to drive the hammers and advance the BCHR 500.

Returning to the illustration, the pressurized air (or other pressurized fluid) is delivered to the BCHR 500 via either or both of the forward string and the rear string. The pressurized air flows through the central drive rod 503 and enters ports defined by the air distribution plates 505. Because the rear string connector 509R is seated against the back of the BCHR 500 (due to the forward feed force translating the central drive rod 503 to a forward most position within the BCHR 500), a majority volume or portion of the pressurized air cannot exhaust to the exterior of the BCHR 500 and paths within the air distribution plates cooperate with cutouts on the central drive rod 503 to direct the majority portion of pressurized air stream to the various hammers 501 in order to promote the percussive cycles of the hammers 501. Notably, in the exemplary embodiment illustrated in the FIG. 9A, a minority volume or portion of the pressurized air stream is allowed to exhaust to the exterior of the BCHR 500 (see air flow arrows in illustration) to provide a constant agitation of accreting debris when the BCHR 500 is in the forward advancing cutting mode. Even so, it is envisioned that other embodiments of a BCHR according to the scope of the solution may not provide for exhaust of a minority volume of the pressurized air stream when the BCHR is in the forward advancing cutting mode.

Figure 9B:
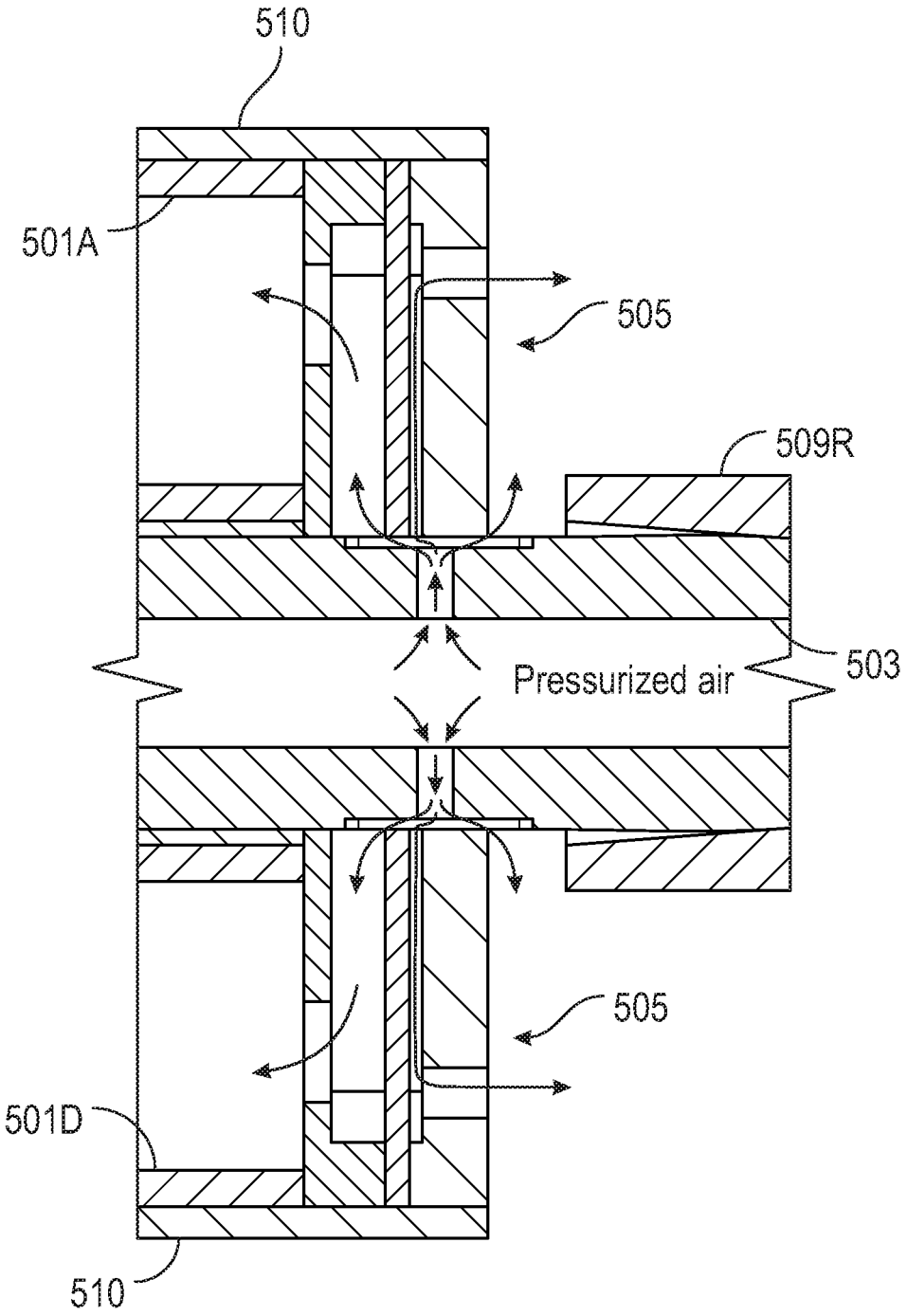
FIG. 9B illustrates a close-up view of the internal air flow path through the air distribution plate assembly of the exemplary bidirectional cluster hammer reamer ("BCHR") of FIG. 5 when it is in a "push" state such as depicted in FIG. 8.

FIG. 9B illustrates a close-up view of the internal air flow path through the air distribution plate assembly of the exemplary bidirectional cluster hammer reamer ("BCHR") of FIG. 5 when it is in a "push" state such as depicted in FIG. 8. Notably, although in this description when the BCHR 500 is in the reverse direction mode it is referred to as the "push" state, it will be understood that a feed force generated by a "pull" of the rear drill string, as opposed to a feed force generated by a "push" of the forward drill string, would also operate to unseat the rear string connector 509R and direct the internal pressurized air to exhaust at the rear of the BCHR 500.

Returning to the illustration, with a reverse feed force applied, the central drive rod 503 is translated to a rearward most position within the BCHR 500, thereby causing the rear string connector 509R to unseat from the back plate of the BCHR 500. The pressurized air flows through the central drive rod 503 and enters ports defined by the air distribution plates 505. The air distribution plates 505 cooperate with cutouts on the exterior of the central drive rod 503 to divert a minority volume or portion of the pressurized air flow to the hammers 501 while simultaneously diverting a majority portion of the pressurized air flow to the exterior of the BCHR 500 (see air flow arrows in illustration). As can be seen in the FIG. 9B illustration, cutout ports on the exterior of the central drive rod 503 coincide with a gap generated by the unseating of the rear string connector 509R when the central drive rod 503 is translated to the rearward most position. Advantageously, the majority portion of the pressurized air stream that is exhausted to the exterior of the BCHR 500 may work to clear accreted debris. Also advantageously, the minority portion of the pressurized air stream that is simultaneously supplied to the hammers 501 may provide enough of a motive force to continue the percussive cycle(s) and cause the bits 600 to continue hammering. Even so, it is envisioned that other embodiments of a BCHR according to the scope of the solution may not provide for direction of a minority volume of the pressurized air stream to continue driving the hammers when the BCHR is in the reverse mode.

Once the debris is cleared, the reverse feed force may be replaced with a forward feed force that causes the rear string connector 509R to reseat and shutoff any exhaust flow of the pressurized air stream to the rear of the BCHR 500. At such point, the percussive cycle(s) of the hammers 501 may be maximized and the BCHR 500 urged forward through the pilot bore to continue expansion and conditioning of the bore, as described above.

While an exemplary embodiment of a new bidirectional cluster hammer reamer for a percussion boring system has been described in detail herein, it is to be understood that the inventive concepts may be otherwise variously embodied and employed. It is intended that the appended claims be construed to include such variations except insofar as limited by the prior art. Possible variations, as described throughout this disclosure, are not to be regarded as a departure from the spirit and scope of the invention. All such possible variations, as would be obvious to one skilled in the art, are intended to be included within the scope of the preceding disclosure and the following claims.

It is understood that any variations of the features of the system and method described in the description section falls within the scope of the invention. There can be many embodiments of this invention as witnessed in some of the figures and the related description. Not all embodiments of a BCHR for a percussion boring system that would fall within the scope of the claims are necessarily represented here.

In the description and claims of the present application, each of the verbs "comprise" "include" and "have", and conjugates thereof, are used to indicate that the object or objects of the verb are not necessarily a complete listing of members, components, elements, or parts of the subject or subjects of the verb.

The various embodiments have been described using detailed descriptions of the embodiments, as well as features, aspects, etc. thereof. The various embodiments are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described, and embodiments of the present invention comprising different combinations of features as noted in the described embodiments, will occur to persons with ordinary skill in the art.

It will be appreciated by persons having ordinary skill in the art that the present invention is not limited by what has been particularly shown and described herein above. Rather the scope of the invention is defined by the claims that follow.

What is claimed is:

1. A bidirectional cluster hammer reamer comprising:

a hammer housing defining a front end and a rear end of the bidirectional cluster hammer reamer;

a central drive rod positioned coaxially within the hammer housing;

a plurality of percussion hammers arranged within the hammer housing and around the central drive rod;

a plurality of bits at the front end, each slidably connected via a chuck component to an associated one of the plurality of percussion hammers;

an air distribution assembly positioned at the rear end; and forward and rear string connectors operably coupling the central drive rod to, respectively, a forward drill string positioned ahead of the hammer housing and a rear drill string positioned behind the hammer housing;

wherein a pressurized fluid supplied through the central drive rod is directed through the air distribution assembly to provide a motive force for promoting a percussive cycle in each of the plurality of percussion hammers;

wherein a pulling force applied via the forward drill string operates to pull the bidirectional cluster hammer reamer through a pilot bore in a substrate;

wherein a pushing force applied via the rear drill string operates to push the bidirectional cluster hammer reamer through the pilot bore; and wherein the central drive rod is configured to translate between a forward most position and a rear most position such that the central drive rod is in the forward most position when either the pulling force is applied via the forward drill string or the pushing force is applied via the rear drill string, and the central drive rod is in the rear most position when either a pushing force is applied via the forward drill string or a pulling force is applied via the rear drill string.

2. The bidirectional cluster hammer reamer of claim 1, wherein the plurality of percussion hammers consists of four to six percussion hammers.

3. The bidirectional cluster hammer reamer of claim 1, wherein the central drive rod comprises one or more cutout areas on its surface.

4. The bidirectional cluster hammer reamer of claim 3, wherein when the central drive rod is in the forward most position the cutout areas cooperate with the air distribution assembly to supply the pressurized fluid to the plurality of percussion hammers.

5. The bidirectional cluster hammer reamer of claim 3, wherein when the central drive rod is in the rear most position the cutout areas cooperate with the air distribution assembly to supply the pressurized fluid to the exterior of the bidirectional cluster hammer reamer.

6. The bidirectional cluster hammer reamer of claim 3, wherein when the central drive rod is in the rear most position the cutout areas cooperate with the air distribution assembly to supply a first portion of the pressurized fluid to the plurality of percussion hammers and a second portion of the pressurized fluid to the exterior of the bidirectional cluster hammer reamer.

7. The bidirectional cluster hammer reamer of claim 1, wherein the air distribution assembly is comprised of a plurality of plates defining a series of flow paths.

8. The bidirectional cluster hammer reamer of claim 1, wherein the hammer housing comprises one or more support plates configured to slidably engage the central drive rod and mechanically support the plurality of percussion hammers.

9. The bidirectional cluster hammer reamer of claim 1, wherein the central drive rod comprises a forward string connector and a rear string connector for mechanically engaging a forward drill string and a rear drill string.

* * * * *